US007835670B2

(12) United States Patent
Endou

(10) Patent No.: US 7,835,670 B2
(45) Date of Patent: Nov. 16, 2010

(54) IMAGE FORMING APPARATUS REDUCING BACKGROUND CONTAMINATION

(75) Inventor: Osamu Endou, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 262 days.

(21) Appl. No.: 12/099,482

(22) Filed: Apr. 8, 2008

(65) Prior Publication Data

US 2009/0060584 A1 Mar. 5, 2009

(30) Foreign Application Priority Data

Apr. 9, 2007 (JP) ..... 2007-101637

(51) Int. Cl.
*G03G 15/01* (2006.01)
*G03G 21/00* (2006.01)

(52) U.S. Cl. ..... 399/223; 399/302; 399/359

(58) Field of Classification Search ..... 399/28, 399/29, 223, 257, 299, 302, 359, 66, 99
See application file for complete search history.

(56) References Cited

U.S. PATENT DOCUMENTS

| | | | | |
|---|---|---|---|---|
| 5,606,408 | A | 2/1997 | Yano et al. | |
| 5,740,494 | A | 4/1998 | Shoji et al. | |
| 6,398,345 | B1 | 6/2002 | Sakai et al. | |
| 6,519,434 | B2 * | 2/2003 | Izumi et al. | 399/223 |
| 6,611,672 | B2 * | 8/2003 | Aoki et al. | 399/359 |
| 6,643,486 | B1 | 11/2003 | Endoh et al. | |
| 6,775,506 | B2 | 8/2004 | Endoh et al. | |
| 6,795,674 | B2 | 9/2004 | Endoh et al. | |
| 7,072,608 | B2 * | 7/2006 | Takada | 399/299 |
| 2007/0086812 | A1 | 4/2007 | Iio et al. | |

FOREIGN PATENT DOCUMENTS

| | | |
|---|---|---|
| JP | 2000-89542 | 3/2000 |
| JP | 2002-357938 | 12/2002 |
| JP | 2004-20661 | 1/2004 |
| JP | 2005-189901 | 7/2005 |
| JP | 2006-119604 | 5/2006 |

OTHER PUBLICATIONS

U.S. Appl. No. 10/762,254, filed Jan. 23, 2004, Masato Iio, et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image forming device includes a plurality of image forming units provided in parallel comprising a black image forming unit to form a black toner image and a plurality of color image forming units to form color toner images, an intermediate transfer device to primarily transfer color toner images formed by superimposing the toner images formed at each image forming unit, and a secondary transfer unit to transfer the color toner image to a transfer paper. The color image forming unit employs a non-magnetic-contact-type single-component development device to develop each color toner image with a single-component developer, and the black image forming unit is provided closest to the secondary transfer unit and employs a contact-type two-component development device to develop a black toner image with a two-component developer.

6 Claims, 4 Drawing Sheets

IMAGE FORMING APPARATUS REDUCING BACKGROUND CONTAMINATION

CROSS-REFERENCE TO RELATED APPLICATIONS

This application claims priority to Japanese Patent Application No. 2007-101637, filed on Apr. 9, 2007, the entire contents of which are hereby incorporated by reference herein.

BACKGROUND

1. Field

The present invention relates to an image forming apparatus capable of reducing background contamination.

2. Background Art

A background-art image forming apparatus that employs an electrophotographic method commonly applies toner as dry ink to make visible an image in an image forming operation. Such an apparatus may be a printer, a copier, a facsimile machine, and a multi-function system, for example. The multi-function system combines various image forming related functions including at least two of printing, copying, and facsimile functions.

There are mainly two types of full-color image forming apparatuses that employ an electrophotographic method. One is a single-drum-type full-color image forming apparatus, and another is a tandem-type full-color image forming apparatus.

The single-drum-type full-color image forming apparatus includes a photoreceptor and a plurality of developing devices for each of multiple colors disposed around the photoreceptor. A toner image is developed by attaching toner at each developing device to form a composite color toner image on the photoreceptor. The composite color toner image is then transferred to a transfer paper to record a color image.

By contrast, the tandem-type full-color image forming apparatus includes a plurality of photoreceptors provided in parallel, each of which has a developing device. A single color toner image is formed on each photoreceptor. The single color toner images are then transferred successively to record a composite color image.

Comparing the single-drum and tandem types, it can be seen that the single-drum type achieves a compact, cost-effective system because the single-drum includes only one photoreceptor. However, with such an arrangement it is difficult to achieve high-speed image formation because a full color image is formed by performing multiple steps repeatedly with one photoreceptor (normally four times). By contrast, tandem-type image forming apparatuses can obtain high-speed image formation, although their relatively large size can be costly. Due to increasing demand for high-speed image formation for a full color image similarly to a monochrome image, the tandem-type full-color image forming apparatus has received much attention recently.

There are two types of tandem image forming apparatuses, direct-transfer and indirect-transfer. In the direct-transfer-tandem image forming apparatus, toner images formed on each photoreceptor are transferred successively by a transfer device to a transfer paper being conveyed by a conveyance belt.

By contrast, FIG. 1 is a schematic diagram representing a configuration of the indirect-transfer-tandem-type image forming apparatus that employs an electrophotographic method and uses a two-component-development-type developing device. The indirect-transfer-tandem image forming apparatus includes photoreceptors 11, a primary transfer device 23, a secondary transfer device 24, and an intermediate transfer device 25. As shown in FIG. 1, toner images formed on each photoreceptor 11 are transferred successively to the intermediate transfer device 25 by the primary transfer device 23. The toner image on the transfer device 25 is then transferred to a transfer paper by the secondary transfer device 24.

In the indirect-transfer-tandem image forming apparatus, a secondary transfer position can be set freely. Therefore, a distance between a paper feed unit and a fixing device 28 can be made short. Accordingly, it is possible to shorten a first print time that is a time to print the first paper starting from input of a print instruction to actual printing. Further, it is possible to make fixing a paper jam easy.

The indirect-transfer-tandem-type image forming apparatus further includes a charging device to charge each photoreceptor, a cleaning device 22, and a transfer belt cleaning device 26. Thus, using the tandem image forming apparatus which employs the electrophotographic method, it is easy to obtain a high speed performance. However, there is a drawback in that the image forming apparatus becomes a large system.

FIG. 2 is a schematic diagram representing a configuration of the two-component-development-type developing device which includes a recycle unit. The two-component-development-type developing device includes a two-component-development-type developing unit 21, a toner cartridge 27 which supplies toner to the two-component-development-type developing unit 21, and a toner supply unit.

Meanwhile, to make the image forming apparatus more compact, a single-component-development-type developing unit 29 can be employed as shown in FIG. 3.

FIG. 3 is a schematic diagram representing a configuration of the indirect-transfer-tandem-type image forming apparatus which employs an electrophotographic method and uses the single-component-development-type developing device.

FIG. 4 is a schematic diagram representing a configuration of the non-magnetic single-component-development-type developing device 29 in which no recycle unit is included.

The single-component-development-type developing device 29 contains toner in the developing device 29. Therefore, it is not necessary to supply toner from the toner cartridge 27. Accordingly, the size of the image forming apparatus can be made compact by saving a space of the toner cartridge 27 and the toner supply unit, which are not necessary.

The single-component-development-type developing device 29 develops toner image with a predetermined linear velocity of a development roller 31 by forcing the development roller 31 to contact the photoreceptor 11. It may be possible to develop the toner image without contacting with the photoreceptor 11. However, an AC bias voltage may be required in addition to a development bias voltage so as to obtain sufficient development efficiency. When the development roller 31 is forced to contact the photoreceptor 11, sufficient development efficiency can be obtained.

The toner is supplied to a surface of the development roller 31 from a toner storage 33 by the supply roller 32. A toner limiting member 34 limits a toner thickness to have a predetermined thickness. However, using such single-component-development-type developing device 29, background contamination on the photoreceptor 11 will occur in a shorter time than in the two-component-development-type developing unit 21.

FIGS. 5A and 5B are illustrations of how black toner spoils other color toner images. As shown in FIG. 5A, background contamination toner which causes background contamination is reversely charged in a high percentage. Accordingly, even if the background contamination toner causes background contamination on the photoreceptor 11, the background contamination toner is not transferred at the transfer devices 23 and 24. Consequently, the background contamination toner does not cause a problem at a non-image portion of the color image on the transfer paper. However, when the black toner image forming unit is provided at a downstream side in a rotational direction of the intermediate transfer device 25 in the image forming apparatus which uses color toner, negatively charged toner on the intermediate transfer device 25 attracts the background contamination toner which is reversely charged as shown in FIG. 5B, and is transferred to the intermediate transfer device 25.

In FIGS. 5A and 5B, yellow (Y) toner image is formed on the intermediate transfer device 25. The black toner is most striking when the black toner is attached in yellow color which has a high brightness. In the reverse case in which the yellow color toner is attached in black toner, the yellow color toner is not striking. Accordingly, when the yellow toner image forming unit is provided at a downstream side in a rotational direction of the intermediate transfer device 25, there is no substantial problem. A relation between cyan color which has a high brightness and the black is similar to a relation between the yellow color and the black. Namely, when the cyan toner image forming unit is provided at a downstream side in a rotational direction of the intermediate transfer device 25, there is no substantial problem also. However, in these cases, a distance between a primary transfer position and a secondary transfer position of the color black becomes long. As a result, a first print time for monochrome print becomes longer.

Another background-art image forming apparatus is proposed to form a color image having a high degree of brilliancy and a high quality by using magnetic toner for black toner and non-magnetic toner for other color toner image. The background-art image forming apparatus further includes a second station on which a single color image such as single the color black is formed with the magnetic toner, differently of the station in which the two-component-development-type developing unit is employed.

However, the background-art image forming apparatus is a direct-transfer-tandem image forming apparatus in which toner images are transferred successively on the transfer paper conveyed by a conveyance belt. Background contamination toner may be transferred to the intermediate transfer device by being attracted by the negatively charged toner which has a reverse polarity to the background contamination toner. Therefore, it is not sufficient to avoid such background contamination problem using the background-art image forming apparatus described above.

SUMMARY

This patent specification describes a novel image forming apparatus which includes a plurality of image forming units provided in parallel and comprising a black image forming unit to form a black toner image and a plurality of color image forming units to form each color toner image; an intermediate transfer device to primarily transfer a color toner image formed by superimposing the toner images formed at each image forming unit; and a secondary transfer unit to transfer the color toner image to a transfer paper. The color image forming unit employs a non-magnetic-contact-type single-component development device to develop each color toner image with a single-component developer, and the black image forming unit is provided closest to the secondary transfer unit and employs a contact-type two-component development device to develop a black toner image with a two-component developer.

This patent specification further describes an image forming apparatus which includes a plurality of image forming units. Each color image forming unit determines a threshold value for a size of an output image area, the color image forming unit performs a development process with a predetermined toner amount after image forming, and a bias voltage having a reverse polarity to a voltage for transferring to the intermediate transfer device is applied to the developed toner while the developed toner passes through a primary transfer nip when the size of the output image area size is less than the threshold value.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
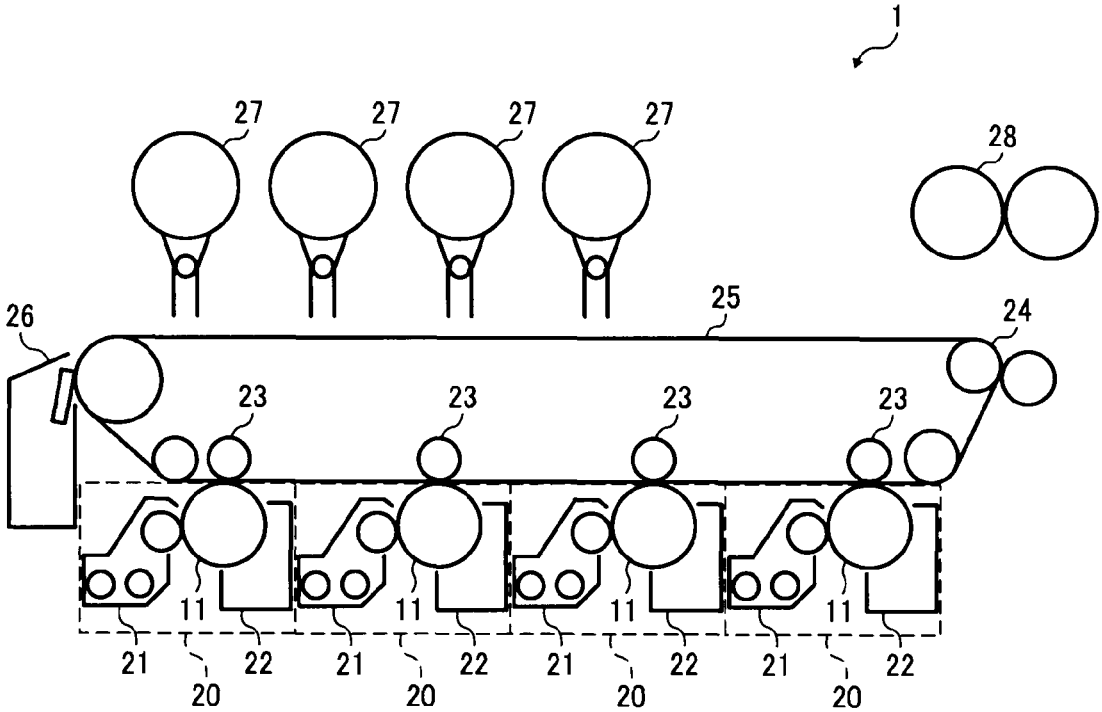
FIG. 1 is a schematic diagram representing a configuration of an indirect-transfer tandem-type image forming apparatus which employs an electrophotographic method and uses a two-component-development-type developing device.

In describing embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a description is given of an example embodiment.

Figure 6:
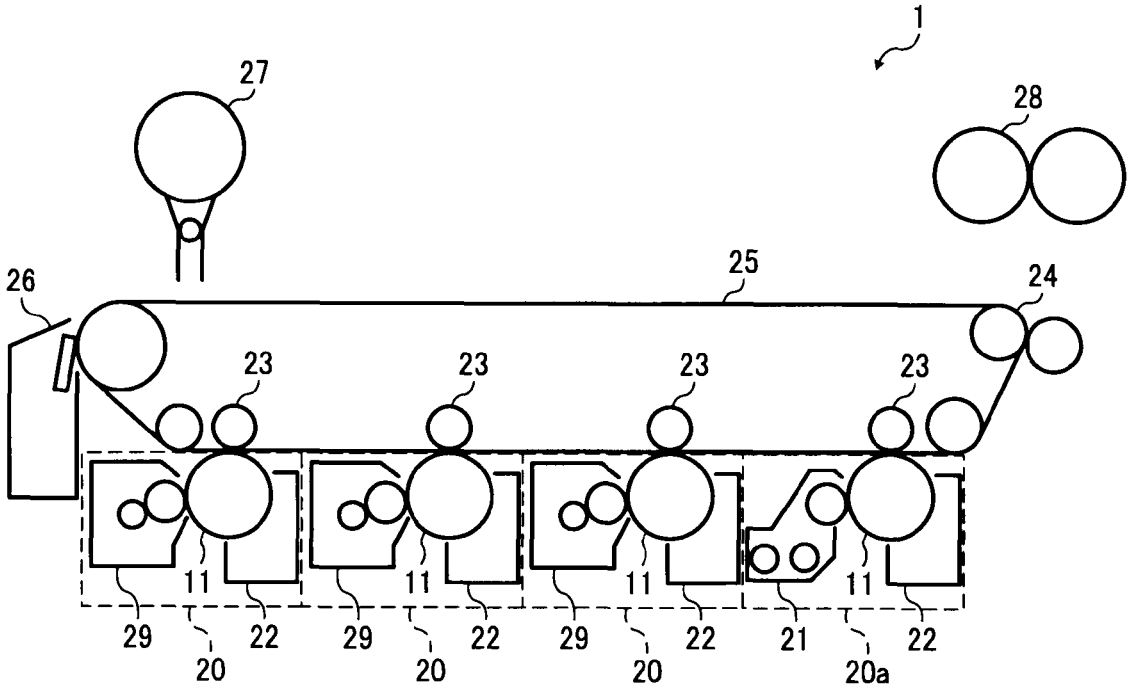
FIG. 6 is a schematic diagram of an example embodiment of an image forming apparatus according to a present disclosure.

FIG. 6 is a schematic diagram of an example embodiment of an image forming apparatus 1 according to a present disclosure. The image forming apparatus 1 includes a plurality of image forming units 20 and 20*a* provided in parallel, an intermediate transfer device 25, and a secondary transfer unit 24 to transfer a color toner image to a transfer paper. The plurality of image forming units 20 include a black image forming unit to form a black toner image, and a plurality of color image forming units to form each color toner image.

As shown in FIG. 6, the black image forming unit 20*a* is provided closest to the secondary transfer unit 24. The three color image forming units 20 employ a single-component development device to develop each color toner image with a single-component developer, and the black image forming unit 20*a* employs a two-component development device to develop a black toner image with a two-component developer. It is preferable that a non-magnetic-single-component toner is used for the three color toners because there are few magnetic-single-component toner with adequate transparency.

In the image forming apparatus having such a configuration, background contamination may not be accelerated with time. Accordingly, background contamination by the black toner on a yellow or cyan color toner image may not be striking. In addition, Since the black image forming unit 20*a* is provided closest to the secondary transfer unit 24, it is possible to shorten a first print time at a monochrome print using black toner. The first print time is a time to print the first paper from a print instruction. Further, a size of the image forming apparatus can be made compact by saving a space of a toner cartridge and a toner supply unit which are not necessary in comparison to an image forming apparatus that employs the single-component development device for all color image forming units including the image forming unit for the color black.

Figure 2:
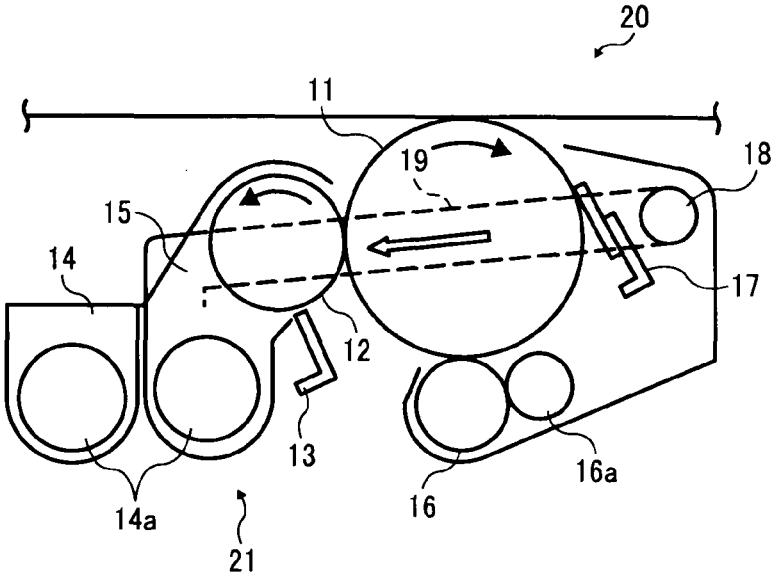
FIG. 2 is a schematic diagram representing a configuration of the two-component-development-type developing device which includes a recycle unit.
Figure 3:
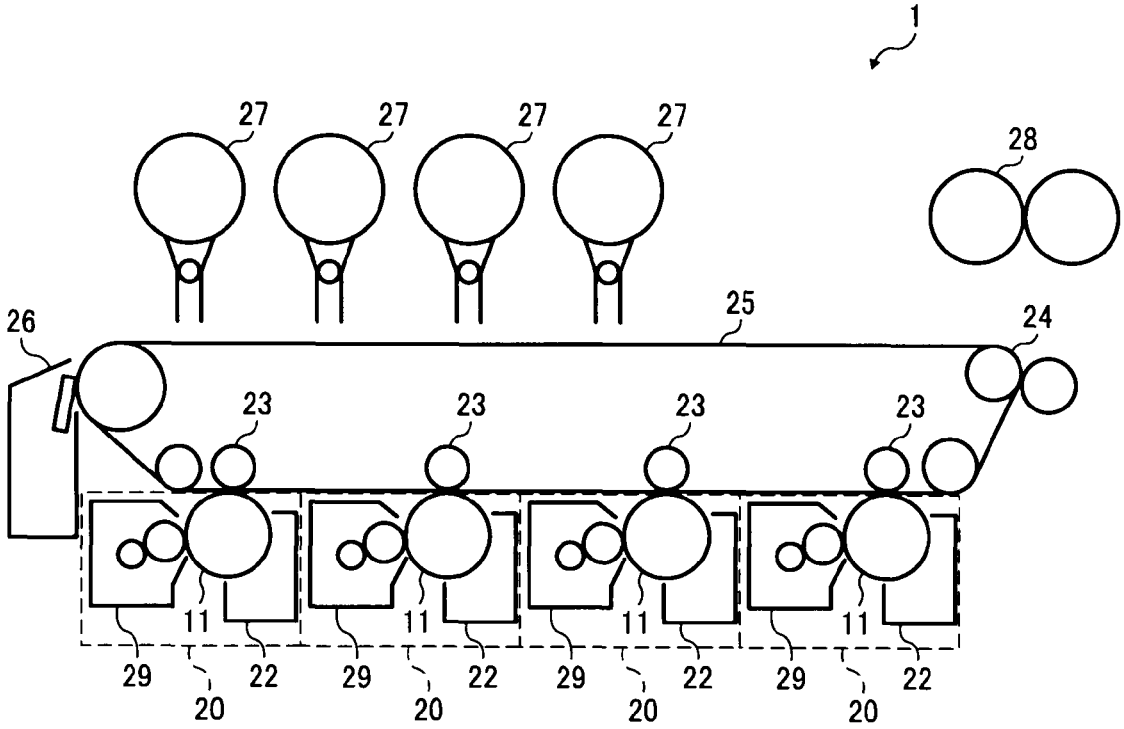
FIG. 3 is a schematic diagram representing a configuration of another indirect-transfer-tandem-type image forming apparatus which employs an electrophotographic method and uses a single-component-development-type developing device.
Figure 4:
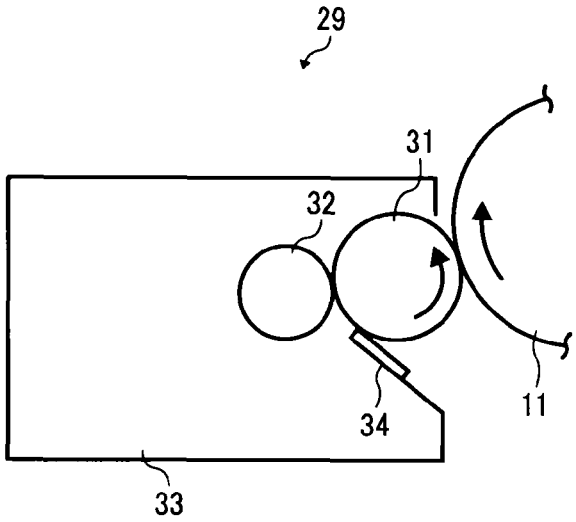
FIG. 4 is a schematic diagram representing a configuration of a non-magnetic single-component-development-type developing device in which no recycle unit is included.
Figure 5A:
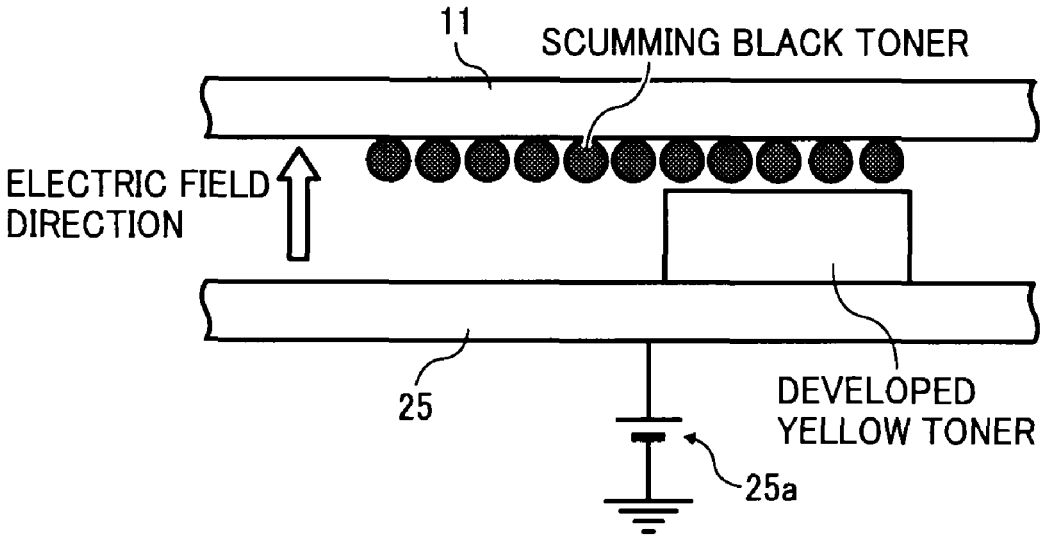
FIGS. 5A and 5B are illustrations of how black toner spoils other color toner images.
Figure 5B:
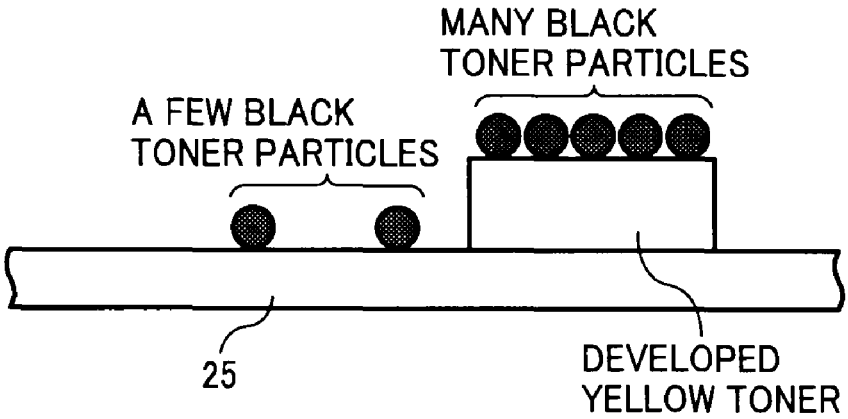

In the image forming apparatus 1 according to the present disclosure, the black image forming unit 20*a* includes a recycle unit 19 which returns toner collected at a photoreceptor cleaning device 22 to the developing device 21 as shown in FIG. 2. Further, the color image forming units do not include a recycle unit 19 which returns toner collected at a photoreceptor cleaning device 22 to the developing device 21.

Referring to FIG. 2, toner cleaned at the photoreceptor 11 is conveyed from the photoreceptor cleaning device 22 to the toner storage (not shown) and is stored in the toner storage with toner cleaned at the intermediate transfer unit 25. Meanwhile, when the cleaned toner is thrown out as disposal toner, a certain percentage of toner is wasted. For this reason, the toner collected by the photoreceptor cleaning device 22 of the black image forming unit 20*a* is reused as recycled toner using the configuration as shown in FIG. 2. The photoreceptor 11 rotates in a direction shown by an arrow in FIG. 2. The development roller 12 is provided close to the photoreceptor 11 with a very small gap Gp. In a developer agitation unit 14, the two-component developer comprised of toner and magnetic carrier is circulated and agitated. As a result, the toner is charged, and is attached to the carrier.

The development roller 12 includes magnets fixed to an inside of the development roller 12. The developer in a developer supplier 15 is pulled up by a magnetic force while the development roller 12 having a cylindrical shape is rotating in a direction shown by an arrow in FIG. 2. The developer is limited to a predetermined amount by a developer limit member 13, and forms a magnetic brush at a position where the photoreceptor 11 faces the development roller 12.

A surface speed of the development roller 12 (development roller line speed) is set to be faster than a surface speed of the photoreceptor 11 (photoreceptor line speed). A leading edge of the magnetic brush touches the photoreceptor 11 so that the toner is supplied. In FIG. 2, a charging roller 16 and a cleaning roller 16*a* are charging devices. A developed toner is transferred to an intermediate transfer device 25 at a nip between the photoreceptor 11 and the intermediate transfer device 25. The developed toner is not completely transferred, and a certain percentage of the toner remains on the photoreceptor 11 as transfer-residual toner. Further, most of background contamination toner on the photoreceptor 11 which causes background contamination is not transferred and remains on the photoreceptor 11. The background contamination toner remained on the photoreceptor 11 is cleaned by a cleaning blade 17, and is conveyed by a conveyance member 18 to a rear side of the image forming units 20. At the rear side of the image forming units 20, the toner is conveyed in a direction shown by an arrow as shown in FIG. 2 by the recycle unit 19. The toner is dropped to the developer supplier 15 for recycle use. According to this configuration, it is possible to form an image efficiently without waste of the toner.

In many cases, the background contamination toner is reversely charged. Such a background contamination toner deteriorates and a charging efficiency of the background contamination toner decreases. In the two-component-development-type developing unit 21, since so much background contamination does not occur, it does not cause a problem that the toner cleaned is returned to the two-component-development-type developing unit 21. However, in the single-component-development-type developing unit 29, background contamination on the photoreceptor 11 increases with time as described previously. When the toner is returned to the single-component-development-type developing unit 29, the toner charging efficiency decreases the longer it remains in the developing device 29, resulting in further deterioration of the background contamination.

In this example embodiment, the image forming unit for the color black includes a recycle unit which returns toner cleaned in a photoreceptor cleaning process to the developing unit. Meanwhile, the image forming units for other colors do not include a recycle unit. In this configuration, the black toner is not thrown out, but is reused. Consequently, it is possible to keep a level in which background contamination does not affect a quality of a color image.

In the image forming apparatus 1 according to the present disclosure, each color image forming unit 20 determines a threshold value for a size of an output image area for every paper. When the size of the output image area is less than the threshold value, the image forming apparatus 1 performs a development process with a predetermined toner amount after image forming. Further, a bias voltage having a reverse polarity to a voltage for transferring to the intermediate transfer device 25 is applied to the developed toner, while the developed toner passes through a primary transfer nip.

Since a certain percentage of color images do not need a specific color, it is common that the color image forming unit for the specific color forms a relatively small image area on an average. When the color image forming unit 20 successively forms images each of which includes small image area for the specific color, the toner is being circulated in the developing device 29 until the toner stored in the developing device 29 is used for development. Accordingly, the toner experiences a lot of stress until the toner is developed. As a result, the toner deteriorates and transfer efficiency of the toner decreases. Finally, a transfer rate of the toner decreases significantly to a low level.

To avoid such a problem, average output image forming area at each image forming unit 20 is counted. When the average output image forming area is less than a predetermined value, a predetermined amount of toner is developed on the photoreceptor 11 after image forming process (toner ejection). By this toner ejection process, it is possible to shorten a circulation time of the toner in the developing device 29 until the toner is developed.

A case in which the toner ejected at the toner ejection process is transferred to the intermediate transfer device 25 will be described. A portion of the toner may transfer reversely to the photoreceptor 11 from the intermediate transfer device 25, when the toner transferred onto the intermediate transfer device 25 of the image forming unit 20 arranged upstream of a rotational direction of the transfer device 25 passes through the image forming unit 20 arranged at a downstream of the rotational direction of the transfer device 25. Such toner transferred reversely is collected by the cleaning device 22 for the photoreceptor 11, generally resulting in no problem. However, the toner enters the color black developing device 21 through the color black cleaning device 22. Consequently, other color toner mixes in the black toner. To avoid such a mixture, a bias voltage having a reverse polarity to a voltage for transferring to the intermediate transfer device 25 is applied to the developed toner while the toner developed at the image forming unit 20 passes through a primary transfer nip. As a result, ejection toner is not transferred to the intermediate transfer device 25. Accordingly, it can be avoided that reverse transfer of the ejection toner of color toner enters the image forming unit 20 for the color black and the ejection toner of color toner mixes with the black toner.

Further, in the image forming apparatus 1 according to the present disclosure, each color image forming unit 20 determines a threshold value for a size of an output image area for every paper. When the size of the output image area size is less than the threshold value, the image forming apparatus 1 performs a development process with a predetermined toner amount after image forming. Further, a bias voltage having an equal polarity to a voltage for transferring to the intermediate transfer device 25 is applied to the developed toner while the developed toner passes through a primary transfer nip. Then, when the color toner transferred to the intermediate transfer device 25 passes through the image forming unit for the color black, a primary bias voltage which has an equal polarity to a bias voltage used at no output and is smaller than image forming process is applied.

The ejection toner ejected at the image forming unit for color toner is returned to the cleaning device 22 for the photoreceptor 11. However, it is not possible to return the ejection toner in some image forming apparatuses, for example, an image forming apparatus in which the developing device 29, the photoreceptor 11, the charging device, and the cleaning device 22 are integrated. Using such image forming apparatus, it is easy for a user to supply a new toner cartridge and to exchange the image forming unit at one time when the toner ends.

The image forming apparatus with this configuration may include a disposal toner storage to store disposal toner collected by the cleaning device 22 of the photoreceptor 11 without a separate disposal toner storage. It is not necessary to have a relatively large size of the disposal toner storage for average amounts of transfer residual toner and background contamination.

However, in a case in which a threshold of the output image area is determined to be 3%, when 0.5% of the image is output on an average, the ejection toner becomes disposal toner by a toner amount for 2.5% of an image. Therefore, the disposal toner storage requires a relatively large capacity. Accordingly, it is difficult to integrate the disposal toner storage with the image forming unit. As a result, it is difficult for the user to exchange an integrated cassette including the disposal toner storage.

To solve such a problem, when the ejection toner for the color image forming unit 20 passes through the primary transfer nip, a bias voltage having an equal polarity to a voltage for transferring to the intermediate transfer device 25 is applied to the developed toner to transfer on the intermediate transfer device 25.

As described above, the color toner is transferred reversely at the primary transfer device 23 for the color black. A control procedure described below will be performed to avoid such problem. A constant current control is generally employed to generate the primary transfer bias.

Figure 7:
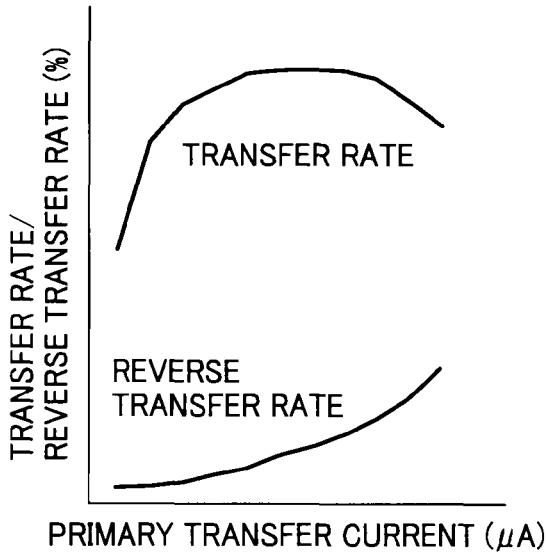
FIG. 7 is a graph representing a relation between transfer rate/reverse transfer rate and primary transfer current.

FIG. 7 is a graph showing general relations of transfer rate and reverse transfer rate to primary transfer current values. Referring to FIG. 7, the reverse transfer rate is low at no output or at small primary transfer current value. However, the transfer rate is also low. Therefore, the reverse transfer rate can not be made low dramatically because the transfer rate is set to be high at a normal transfer timing.

In the image forming apparatus 1 according to the present disclosure, when the color toner transferred to the intermediate transfer device 25 passes through the image forming unit for the color black, a primary bias voltage which has an equal polarity to a bias voltage used at no output or image forming process and is smaller than the bias voltage at the image forming process is applied. Accordingly, the reverse transfer can be reduced dramatically so that it is possible to keep a sufficient level in which other color toner mixed in the black toner does not cause a visual problem.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as their number, position, and shape, are not limited the embodiments and thus may be set as preferred. It is therefore to be understood that, within the scope of the appended claims, the disclosure of this patent specification may be practiced otherwise than as specifically described herein.

What is claimed is:

1. An image forming apparatus, comprising:

a plurality of image forming units provided in parallel, and configured to form a color toner image at each image forming unit, the plurality of image forming units including a black image forming unit configured to form a black toner image, and a plurality of color image forming units configured to form each color toner image;

an intermediate transfer device configured to primarily transfer a color toner image formed by superimposing the toner images formed at each image forming unit; and a secondary transfer unit configured to transfer the color toner image to a transfer paper, wherein the color image forming units include a non-magnetic-contact-type single-component development device to develop each color toner image with a single-component developer, and the black image forming unit is provided closest to the secondary transfer unit and includes a contact-type two-component development device to develop a black toner image with a two-component developer, each color image forming unit determines a threshold value for a size of an output image area, the color image forming unit performs a development process with a predetermined toner amount after image forming, and a bias voltage having a reverse polarity to a voltage for transferring to the intermediate transfer device is applied to the developed toner while the developed toner passes through a primary transfer nip when the size of the output image area size is less than the threshold value determined by each of the color image forming units.

2. The image forming apparatus of claim 1, wherein the black image forming unit includes a recycle unit which returns toner collected in a photoreceptor cleaning process.

3. The image forming apparatus of claim 1, wherein only the black image forming unit includes a recycle unit which returns toner collected in a photoreceptor cleaning process.

4. An image forming apparatus comprising:

a plurality of image forming units provided in parallel, and configured to form a color toner image at each image forming unit, the plurality of image forming units including a black image forming unit configured to form a black toner image, and a plurality of color image forming units configured to form each color toner image;

an intermediate transfer device configured to primarily transfer a color toner image formed by superimposing the toner images formed at each image forming unit; and a secondary transfer unit configured to transfer the color toner image to a transfer paper, wherein the color image forming units include a non-magnetic-contact-type single-component development device to develop each color toner image with a single-component developer, and the black image forming unit is provided closest to the secondary transfer unit and includes a contact-type two-component development device to develop a black toner image with a two-component developer, each color image forming unit determines a threshold value for a size of the output image area;

the color image forming unit performs a development process with a predetermined toner amount after image forming;

a bias voltage having an equal polarity to a voltage for transferring to the intermediate transfer device is applied to the developed toner while the developed toner passes through a primary transfer nip when the size of the output image area is less than the threshold value; and a primary transfer bias voltage which has an equal polarity to a bias voltage used at no output or image forming process and is smaller than a bias voltage for image forming process is applied when color toner transferred to the intermediate transfer device passes through the image forming unit for the color black.

5. The image forming apparatus of claim 4, wherein the black image forming unit includes a recycle unit which returns toner collected in a photoreceptor cleaning process.

6. The image forming apparatus of claim 4, wherein only the black image forming unit includes a recycle unit which returns toner collected in a photoreceptor cleaning process.

* * * * *